United States Patent [19]

Isozumi

[11] Patent Number: 4,755,688

[45] Date of Patent: Jul. 5, 1988

[54] AUXILIARY ROTATION TYPE STARTER

[75] Inventor: Shuzo Isozumi, Himeji, Japan

[73] Assignee: Mitsubishi Denki Kabushiki Kaisha, Tokyo, Japan

[21] Appl. No.: 116,055

[22] Filed: Nov. 2, 1987

[30] Foreign Application Priority Data

Nov. 19, 1986 [JP] Japan ..... 61-277037

[51] Int. Cl.[4] ..... F02D 11/10; F02N 11/08

[52] U.S. Cl. ..... 290/38 R; 290/48

[58] Field of Search ..... 290/30, 37, 38 R, 40 R, 290/48; 123/179 R, 179 B, 478, 480; 74/7 R, 7 A, 6

[56] References Cited

U.S. PATENT DOCUMENTS

| | | | |
|---|---|---|---|
| 3,528,522 | 9/1970 | Turke, Jr. | 290/38 R |
| 3,536,982 | 10/1970 | Jackson | 290/38 R |
| 3,949,236 | 4/1976 | Kurii et al. | 290/48 |
| 4,456,831 | 6/1984 | Kanegae et al. | 290/38 R |
| 4,570,583 | 11/1983 | Hamano et al. | 290/38 D |
| 4,674,344 | 6/1987 | Kulino et al. | 290/48 |

FOREIGN PATENT DOCUMENTS 56-101065 6/1981 Japan .

*Primary Examiner*—Vit W. Miska

*Attorney, Agent, or Firm*—Oblon, Fisher, Spivak, McClelland & Maier

[57] ABSTRACT

An auxiliary rotation type starter has an electromagnetic switch for actuating a motor and an auxiliary switch for actuating the electromagnetic switch. The electromagnetic switch is provided with a current coil and a voltage coil. The current coil has a coil wound in one direction and a coil wound in the opposite direction, and the voltage coil has a coil wound in the one direction. One end of the current coil is connected to the auxiliary switch and the other end is connected to the motor. One end of the voltage coil is connected to the auxiliary coil and the other end is connected to the ground.

3 Claims, 2 Drawing Sheets

AUXILIARY ROTATION TYPE STARTER

BACKGROUND OF THE INVENTION

1. Field of the Invention

The present invention relates to an auxiliary rotation type starter. More particularly, it relates to such a starter that when an engine for an automobile is started, a pinion is rotated before it comes to engage with a ring gear for actuating the engine.

2. Discussion of Background

FIGS. 4 and 5 show a conventional auxiliary rotation type starter. The starter is provided with a pinion 1 adapted to be engaged with or disengaged from a ring gear A which actuates an engine for an automobile. The pinion 1 is connected to an clutch inner member constituting an overrunning clutch 2. One end of a shift lever 5, which is turnable around a pivotal point, is connected to the overrunning clutch 2 and the other end of the shift lever 5 is connected to a plunger rod 4 extending from an electromagnetic switch 3 acting as an engaging switch. Engagement and disengagement of the pinion 1 with respect to the ring gear A is attained by the operation of the electromagnetic switch 3, the shift lever 5 and the overrunnig clutch 2.

The pinion 1 is rotated as follows. On turning-on of the key switch 6 of an automobile, an exciting coil 7 in the electromagnetic switch 3 is energized to attract the plunger rod 4. Then, a movable contact 8 attached to the plunger rod 4 comes to contact with two fixed contacts *9a*, *9b* to close a main contact, whereby a d.c. motor 10 is actuated. A torque by the armature rotary shaft of the d.c. motor 10 is transmitted to the clutch outer member of the overrunning clutch device 2 through a reduction gear device and other elements. The torque is further transmitted from the clutch outer member to the clutch inner member to thereby rotate the pinion 1.

FIG. 5 shows an electric circuit used for the starter as above-mentioned. A current is fed to the exciting coil 7 of the electromagnetic switch 3 through an auxiliary switch 11 which is also an electromagnetic switch. The key switch 6 is electrically connected between a power source (a battery) 12 of the automobile and the exciting coil of the auxiliary switch 11. The exciting coil 7 of the electromagnetic switch 3 is connected to the power source when the fixed contact of the auxiliary switch 11 is made. The exciting coil 7 is composed of a current coil *7a* having a number of turn of N and a voltage coil (a holding coil) *7b* having a number of turn of N. The current coil *7a* is connected to the d.c. motor 10 and the voltage coil *7b* is connected to the negative terminal of the power source.

When the key switch 6 of the automobile is operated, the auxiliary switch 11 is actuated, whereby a current passes in the exciting coil 7, i.e. the current coil *7a* and the voltage coil *7b* of the electromagnetic switch 3. Then, the plunger 4 is moved and at the same time, a current is also fed to the d.c. motor 10 through the current coil *7a* to actuate the motor 10. Accordingly, the pinion 1 is rotated by the d.c. motor 10 while the plunger rod moves the overrunnig clutch 2 through the shift lever 5. In other words, the pinion 1 is rotated by the motor 10 before the pinion 1 is interlocked with the ring gear A. Under the condition, the end face of the pinion 1 slidingly touches the end face of the ring gear A and they are interlocked with each other with shift of one tooth tip. When the pinion 1 and the ring gear A becomes a sufficient interlocking condition, the movable contact 8 is brought to contact with the fixed contacts *9a*, *9b*, whereby the d.c. motor 10 is started under the total voltage application. Thus, the way that the pinion 1 is caused a slight rotation before interlocking with the ring gear A to obtain a desired interlocking condition is called an auxiliary rotation system.

After the pinion 1 has sufficiently interlocked with the ring gear A and the main contact has been closed by bringing the movable contact 8 of the electromagnetic switch 3 to the fixed contacts *9a*, *9b*, there is no substantial amount of current flowing in the current coil *7a* (because of the same potential). Accordingly, the plunger 4 is held by a magnetically attracting force of the voltage coil *7b*.

In the conventional auxiliary rotation type starter, the pinion 1 is brought to be in slide-contact with the end face of the ring gear A and then, is interlocked with the same when a condition of $T > F/g \times r \times \mu$ is established, where F is an attractive force of the electromagnetic switch 3 given when the pinion 1 is brought to contact with the end face of the ring gear A, g is a ratio in length of the shift lever, T is a torque of auxiliary rotation, r is a pitch radius of the pinion 1 and $\mu$ is a friction coefficient of the end faces. However, when the friction coefficient between the pinion 1 and the ring gear A is large, or a voltage is decreased, the torque of auxiliary rotation is reduced to thereby result in a condition of $T < F/g \times r \times \mu$, whereby the pinion 1 sometimes does not slide on the end face of the ring gear A. In this case, a sufficient amount of current can be supplied and the torque T of auxiliary rotation of the pinion 1 can be large if resistance in the current coil *7a* is made small. However, on the contrary, the magnetically attracting force caused by the current coil *7a* becomes large, and therefore a force for moving the overrunnig clutch 2 through the shift lever 5 also becomes large. As a result, a pushing force acting between the end faces of the pinion 1 and the ring gear A becomes large, and $F/g \times r \times \mu$ also becomes large. Thus, measurements of passing a large current in the current coil *7a* results in increase of the torque T as well as $F/g \times r \times \mu$. Thus, there has not been provided a fundamental resolution in the conventional starter.

SUMMARY OF THE INVENTION

It is an object of the present invention to provide an auxiliary rotation type starter assuring smooth and prompt engagement of a pinion with a ring gear by weakening a pushing force of the pinion to the ring gear.

The foregoing and the other objects of the present invention have been attained by providing an auxiliary rotation type starter which comprises an electromagnetic switch device comprising a pinion adapted to be driven by a motor and to be engageable with and disengageable from a ring rear for starting an engine, a shift lever for moving the pinion, a plunger connected to the shift lever, and a main contact to be operated by the plunger to thereby electrically connect the motor to a power source, the electromagnetic switch device being further provided with a current coil and a voltage coil which impart a magnetically attracting force to the plunger; an auxiliary switch device for feeding or cutting a current to the current coil and the voltage coil; a key switch for actuating the auxiliary switch, wherein the current coil has a first coil portion wound in a first direction and a second coil portion wound in a second opposite direction, one end of the current coil being connected to the auxiliary switch device and the other end being connected to the motor, and the voltage coil has at least a third coil portion wound in the first direction, one end of the voltage coil being connected to the auxiliary switch device and the other end being connected to the ground.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
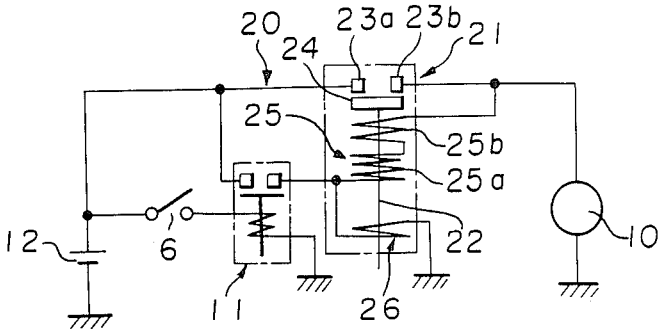
FIG. 1 is a circuit diagram of an embodiment of the auxiliary rotation type starter of the present invention.

Preferred embodiments of the present invention will be described with reference to FIGS. 1 to 3, wherein the same reference numerals designate the same or corresponding parts.

FIG. 1 shows a first embodiment of the auxiliary rotation type starter 20. The starter 20 has an electromagnetic switch 21 actuated by an auxiliary switch 11. The electromagnetic switch 21 is provided with a plunger 22 moved by a magnetically attracting force given by an exciting coil. A movable contact 24, which is brought to contact with two fixed contacts 23*a*, 23*b*, is attached to one end of a rod connected to the plunger 22, and a shift lever 5 is connected to the other end of the rod.

Figure 5:
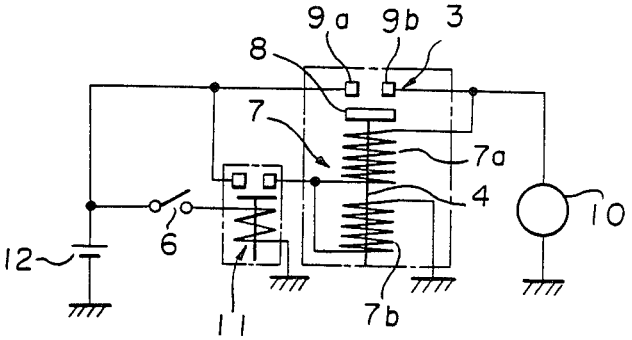
FIG. 5 is a circuit diagram of the conventional auxiliary rotation type starter.

The exciting coil of the electromagnetic switch 21 comprises a current coil 25 and a voltage coil 26. Each one end of the current coil 25 and the voltage coil 26 is connectable to a power source (a battery) 12 through the fixed contacts of the auxiliary switch 11. The current coil 25 has a first coil portion 25*a* wound in a first direction at a number of turn of $n_1$ (hereinbelow referred to as a positively wound coil portion), and a second coil portion 25*b* wound in a second, opposite direction at a number of turn of $n_2$ (hereinbelow, referred to as an oppositely wound coil portion). The positively wound coil portion 25*a* is connected in series to the oppositely wound coil portion 25*b* and the number of turn $n_1$ is greater than the number of turn $n_2$. The sum of the number of turn of $n_1$ and $n_2$ is equal to a number of turn of N in the conventional coil (indicated by a numeral 7*a* in FIG. 5). Accordingly, when the diameter of a wire for forming the current coil 25 is the same as that of the conventional current coil, the same amount of current flows, and accordingly, there is produced the same torque T of auxiliary rotation to the pinion 1.

The voltage coil 26 is wound in the same manner as the positively wound coil portion 25*a* at a number of turn of $(n_1-n_2)$, and the other end of the coil is connected to the negating terminal of the power source 12. Accordingly, an attracting force to the plunger 22 produced by the coils 25, 26 is given by $(n_1-n_2)/N$; thus, $F/g \times r \times \mu$ is low.

When the exciting coil of the electromagnetic switch is actuated by operating a key switch, the d.c. motor is rotated. At the same time, the plunger is moved by a magnetically attracting force produced by the current coil and the voltage coil to thereby push the pinion to the ring gear. The current coil has its coil portion oppositely wound, and therefore, a magnetic force produced by the current coil is weak, with the consequence that a pushing force of the pinion to the ring gear is also small. As a result, the torque of auxiliary rotation is greater than the pushing force, so that the pinion is firstly brought to slide-contact with the end face of the ring gear, and then, is correctly interlocked with the ring gear A, whereby a torque of the pinion is transmitted to the ring gear.

Figure 2:
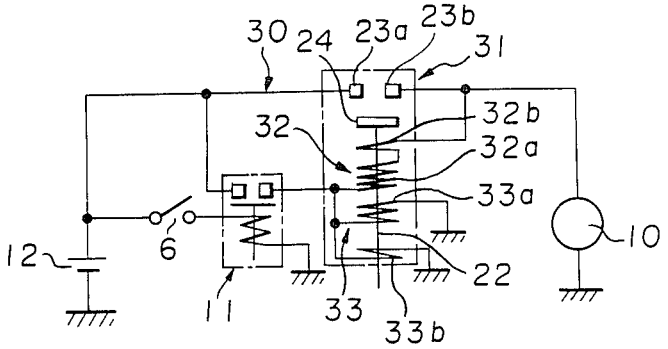
FIG. 2 is a circuit diagram of a second embodiment of the present invention.

FIG. 2 shows a second embodiment of the auxiliary rotation type starter according to the present invention. The starter shown in FIG. 2 is substantially the same as the starter of the first embodiment except for the construction of the exciting coil in an electromagnetic switch 31. Namely, the exciting coil has a current coil 32 and a voltage coil 33. The current coil 32 is composed of a positively wound coil portion 32*a* and an oppositely wound coil portion 32*b* which is connected in series to the positively wound coil portion.

The voltage coil 33 is composed of a positively wound coil portion 33*a* and an oppositely wound coil portion 33*b* which are connected in parallel. In the current coil 32 and the voltage coil 33, the number of turn of the positively wound coil portions 32*a*, 33*a* are respectively greater than the number of turn of the oppositely wound coil portions 32*b*, 33*b*. The same function and effect as in the first embodiment can be attained by the auxiliary rotation type starter 30 of the second embodiment.

Figure 3:
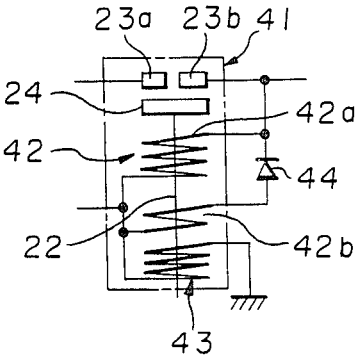
FIG. 3 is a circuit diagram of an electromagnetic switch used for an auxiliary rotation type starter according to a third embodiment of the present invention.
Figure 4:
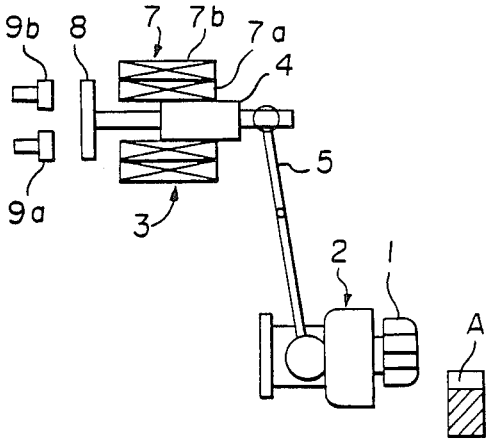
FIG. 4 is a diagram showing a conventional auxiliary rotation type starter.

FIG. 3 shows an electromagnetic switch 41 used in an auxiliary rotation type starter according to a third embodiment of the present invention. The starter of the third embodiment is substantially the same as that of the first embodiment except for the construction of an exciting coil in the electromagnetic switch 41. Namely, the exciting coil has a current coil 42 and a voltage coil 43. The current coil 42 is composed of a positively wound coil portion 42*a* and an oppositely wound coil portion 42*b* which are connected in parallel to each other. The voltage coil 43 is formed by widing a wire in the first direction in the same manner as the coil portion 25*a* in the first embodiment. The number of turn of the positively wound coil portion 42*a* is greater than that of the oppositely wound coil portion 42*b*. Further, the number of turn of the positively wound coil portion 42*a* of the current coil 42 is the same as that of the voltage coil 43. The oppositely wound coil portion 42*b* which is in parallel to the positively wound coil portion 42*a* is connected to the d.c. motor 10 through a diode 44. The purpose of the arrangement is such that when the key switch is opened after the engine has started, contacts can be easily broken. Namely, since there is a phenomenon that when the key switch is opened, there is a state at an instant moment that the movable contact 24 is in contact with the fixed contacts 23*a*, 23*b*, and a current is reversely flown from the fixed contact 23*b* to the current coil 42. Under the condition, the oppositely wound coil portion 42*b* of the current coil and the voltage coil 43 produce a magnetic flux to hold the plunger, while the positively wound current coil 42 produces a magnetic flux to cancel the magnetic flux produced by the coils 42*b*, 43. In this case, the magnetic flux produced by the coils 42*b*, 43 is stronger than the later, and the contacts are not easily broken. However, the construction shown in FIG. 3 facilitates easily breaking of the contacts.

In the third embodiment, the pushing force of the pinion 1 to the ring gear A can be weakened as the first and second embodiments, and the pinion can be mildly rotated, whereby interlocking of the pinion 1 with the ring gear A is quickly and certainly attained.

Thus, in the auxiliary rotation type starter of the present invention, the pinion is caused a rotation and is brought to sliding contact with the end face of the ring gear to realize mutual interlocking even when a frictional coefficient between the end faces of the pinion and the ring gear becomes large or a voltage applied to the electromagnetic switch becomes low. Further, a pushing force of the pinion to the ring gear is weakened and a torque of auxiliary rotation of the pinion can be increased.

Obviously, numerous modifications and variations of the present invention are possible in light of the above teachings. It is therefore to be understood that within the scope of the appended claims, the invention may be practiced otherwise than as specifically described herein.

What is claimed is:

1. An auxiliary rotation type starter which comprises:

an electromagnetic switch device comprising a pinion adapted to be driven by a motor and to be engageable with and disengageable from a ring rear for starting an engine, a shift lever for moving said pinion, a plunger connected to said shift lever, and a main contact to be operated by said plunger to thereby electrically connect said motor to a power source, said electromagnetic switch device being further provided with a current coil and a voltage coil which impart a magnetically attracting force to said plunger;

an auxiliary switch device for feeding or cutting a current to said current coil and said voltage coil;

a key switch for actuating said auxiliary switch, wherein said current coil has a first coil portion wound in a first direction and a second coil portion wound in a second opposite direction, one end of said current coil being connected to said auxiliary switch device and the other end being connected to said motor, and said voltage coil has at least a third coil portion wound in the first direction, one end of said voltage coil being connected to said auxiliary switch device and the other end being connected to the ground.

2. The auxiliary rotation type starter according to claim 1, wherein said first coil portion wound in the first direction is connected in series to said second coil portion wound in the second, opposite direction in said current coil.

3. The auxiliary rotation type starter according to claim 1, wherein said first coil portion is connected in parallel to said second coil portion in said current coil and the other end of said second coil portion is connected to said motor through a diode.

* * * * *